United States Patent [19]

Brendgord

[11] Patent Number: 4,474,364

[45] Date of Patent: Oct. 2, 1984

[54] SURGICAL TABLE

[75] Inventor: Thomas Brendgord, Erie, Pa.

[73] Assignee: American Sterilizer Company, Erie, Pa.

[21] Appl. No.: 445,205

[22] Filed: Nov. 29, 1982

[51] Int. Cl.[3] ..... A61G 13/00

[52] U.S. Cl. ..... 269/325

[58] Field of Search ..... 269/322–328; 128/69–71; 5/66–69; 108/3–7

[56] References Cited

FOREIGN PATENT DOCUMENTS 997407 9/1976 Canada ..... 269/325

529853 6/1955 Italy ..... 269/325

91747 3/1958 Norway ..... 269/325

*Primary Examiner*—Robert C. Watson

*Attorney, Agent, or Firm*—Robert D. Yeager; Andrew J. Cornelius; Christine Ethridge

[57] ABSTRACT

A surgical table having simplified joint mechanisms made possible by the use of two offset columns for support and positioning of the table surface. Each column is attached to the surface at two points and is adapted for individual extension and retraction. The columns extend vertically from a base to the surface. The columns and base are positioned such that there is adequate clearance during surgery for use of auxiliary apparatus such as image amplification equipment.

2 Claims, 7 Drawing Figures

SURGICAL TABLE

BACKGROUND OF THE INVENTION

1. Field of the Invention

The present invention relates to surgical tables, more particularly to a surgical table having a multisectioned patient support surface.

2. Description of the Prior Art

Conventional surgical tables have multisectioned patient support surfaces which can be adjusted to assume a number of positions relative to each other. The patient support surface is supported by a single, relatively thick column which extends upward from a base on the floor to the underside of the patient support surface. Such columns may house hydraulic or similar mechanisms by which the patient support surface is raised and lowered or tilted and flexed. Similar mechanisms which control the positioning of each section of the patient support surface relative to its adjacent section are disposed along the outer edge or the underside of each section. A separate joint mechanism is required at the juncture of adjacent sections. The columns and joint mechanisms, therefore, are necessarily bulky in order to accomodate the positioning mechanisms. The support columns may be situated at the center of the patient support surface, offset from the center, or at one end of said surface. When the column is off center or to one end of the patient support surface and the weight of that surface is not therefore, evenly distributed, the base member must extend farther along the underside of the surface in order to provide balance. Additionally, many conventional surgical tables have control arms and foot pedals which extend from the column into the space under the patient support surface. Because of the bulky columns, a joint mechanisms and bases and the control arm and foot pedal extensions it is difficult to position auxiliary apparatus, such as portable image amplification equipment to permit optional use of such apparatus during surgical procedures.

Accordingly, there is a need for a surgical table that permits better access of auxiliary apparatus under and around the patient support surface without reducing the positional maneuverability necessary for a wide range of surgical procedures.

SUMMARY OF THE INVENTION

The present invention provides a streamlined surgical table having simplified joint mechanisms and greater base clearance for use with auxiliary apparatus than is found in conventional surgical tables. The table includes a base and two support columns which are disposed on opposite sides of a longitudinal axis of a patient support surface having multiple sections and offset from a transverse axis of the surface. Each column may include twin cylinders which are adapted to be individually extended and retracted to determine the position of the surface section to which it is attached. The ability to individually actuate each cylinder provides the means to achieve the range of patient support surface positions found in conventional surgical tables but without the bulky joint mechanisms characteristic of conventional tables.

In the preferred embodiment of the present invention, there are five sections to the patient support surface including serially, a head section, intended to support a patient's head, a spinal section, intended to support the upper torso of a patient, a pelvic section, intended to support the lower torso of a patient, a femoral section, intended to support a patient's thighs, and a foot section, intended to support a patient's calves and feet. Further, the foot section, may be longitudinally sectioned providing individually movable support for each extremity. One column may be attached to the spinal section and one to the femoral section. The position of the pelvic section is thereby determined by the relative positions of the spinal and femoral sections. The head and foot sections may be manually adjusted. Accordingly, the joint mechanism between the sections can be in the form of simple pivot hinges using gear interfaces or any well-known simple pivot device. If the twin cylinder embodiment is desired, one cylinder of the four should be fixed to the base and the others should be pivotally attached to the base. Power for the cylinders may be provided by any conventional power source. The base member should be a streamlined member extending from one column to the other proportioned such that maximum stability is achieved while permitting the requisite clearance for auxiliary apparatus.

BRIEF DESCRIPTION OF THE DRAWINGS

The following detailed description of the preferred embodiment can be better understood if reference is made to the attached drawings in which.

DETAILED DESCRIPTION OF THE PREFERRED EMBODIMENTS

Figure 3:
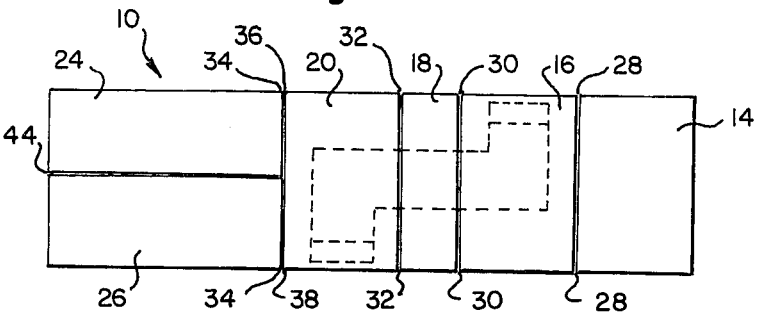
FIG. 3 is a diagrammatic top plan view showing a preferred base construction.
Figure 1:
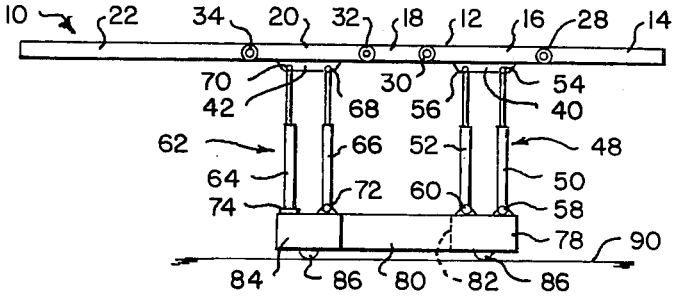
FIG. 1 is a side elevational view of a surgical table embodying this invention.
Figure 2:
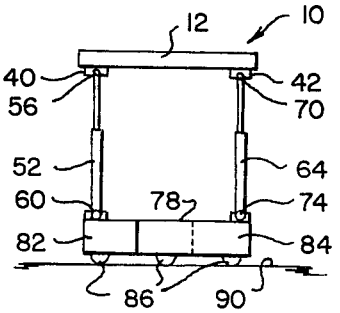
FIG. 2 is an end view.

FIGS. 1 through 7 show a surgical table 10 which is the preferred embodiment of the present invention. Referring to FIG. 1, table 10 includes a patient support surface 12, base 78, and columns 48 and 62. The patient support surface 12 is divided along its length into five sections—a head section 14, a spinal section 16, a pelvic section 18, a femoral section 20, and a foot section 22. Referring to FIG. 3, the foot section 22 may be divided along longitudinal axis 44 of patient support surface 12 into two sections 24 and 26. Head section 14 is pivotally attached at axis 28 to spinal section 16. Spinal section 16 is pivotally attached at axis 30 to pelvic section 18, which in turn is pivotally attached at axis 32 to femoral section 20. Femoral section 20 is pivotally attached at axes 36 and 38 to foot sections 24 and 26, respectively. If desired, foot section 22 may not be divided along longitudinal axis 44. In that case, femoral section 20 is pivotally attached at axis 34 to foot section 22. The means for pivotal attachment of sections 14 through 26 of patient support surface 12 can be any suitable known means of pivotal attachment, such as double hinge or ball joint attachments. Head section 14 and foot sections 24 and 26 can be interchangeable to permit reversing the position of the patient if the base 78 is fixed to the floor 90. Accordingly, head section 14 and foot sections 24 and 26 can be releasably attached to adjacent sections 16 and 20, respectively, in any suitable known fashion. Optional accessories, not shown in the drawings, may be releasably attached to spinal section 16 at axis 28 in place of head section 14 and to femoral section 20 at axis 34 in place of foot section 22.

Referring again to FIG. 1, columns 48 and 62 extend vertically from base 78 to patient support surface 12. Column 48 includes twin cylinders 50 and 52. Column 62 includes twin cylinders 64 and 66. Each column may be enclosed by any suitable flexible material capable of conforming to the movement of the columns 48 and 62.

Figure 5:
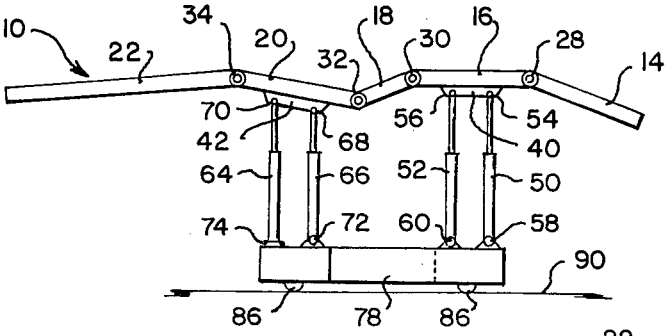
FIG. 5 is a side elevational view showing possible flex positioning of the sections.
Figure 6:
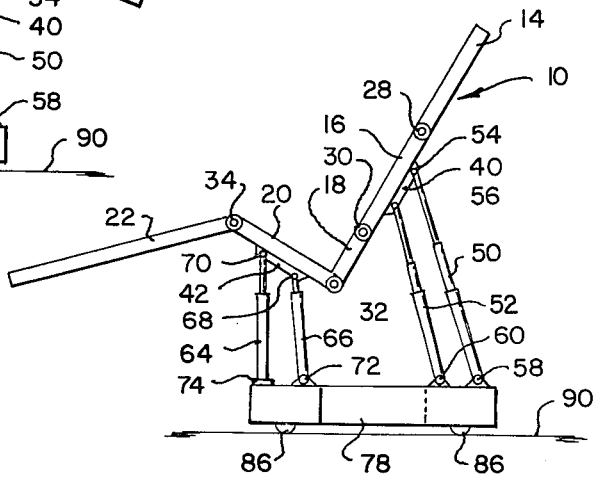
FIG. 6 is a side elevational view showing another possible positioning of the sections.
Figure 7:
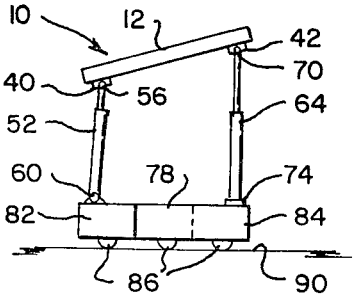
FIG. 7 is an end view showing lateral tilting of the patient support surface.

In one embodiment, twin cylinder 50 is pivotally attached at one end to base 78 on base extension 82 at point 58 and pivotally attached at its other end at point 54 to plate 40 which is fixedly connected to spinal section 16 on one side of the longitudinal axis 44 of patient support surface 12. Twin cylinder 52 is pivotally attached at one end to base 78 on base extension 82 at point 60 and pivotally attached at point 56 to plate 40 in close proximity to twin cylinder 50 attachment point 54 on the same side of longitudinal axis 44. Twin cylinders 50 and 52 can be individually vertically extended and retracted by any suitable known means, thereby determining the longitudinal position of spinal section 16. FIGS. 5 and 6 are illustrative of two such possible positions.

One end of twin cylinder 64 is fixedly attached to base 1 on base extension 84 at point 74 and the other end of twin cylinder 64 is pivotally attached to femoral section 20 at point 70 on plate 42, plate 42 is fixedly connected to femoral section 20 on the opposite side of longitudinal axis 44 from plate 40 to which twin cylinders 50 and 52 are attached. One end of twin cylinder 66 is pivotally attached at point 72 to base extension 84 and pivotally attached at its other end to plate 42 on femoral section 20 at point 68 in close proximity to attachment point 70 of twin clyinder 64 on the same side of longitudinal axis 44. Also, as with twin cylinders 50 and 52, twin cylinders 64 and 66 can be individually extended and retracted by any suitable known means. The longitudinal position of femoral section 20 is determined by the relative degrees to which twin cylinders 64 and 66 are extended, as is more fully explained below.

Cylinders 50, 52, 64 and 66 are actually secured to support surface 12, in the manner described above, using any well-known suitable apparatus.

When cylinder 50 is extended to a greater length than cylinder 52 spinal section 16 tilts towards pelvic section 18. When cylinder 52 is extended to a greater length than cylinder 50, spinal section 16 tilts in the opposite direction, towards head section 14. It can be seen that the same is true for twin cylinders 64 and 66. A greater extension of twin cylinder 64 relative to 66 will tilt femoral section 20 towards pelvic section 18 and a greater extension of twin cylinder 66 relative to 64 will tilt femoral section 20 in the opposite direction, towards foot section 22. The greater the difference in the degree of extension of a cylinder of a pair relative to the remaining cylinder of the pair, the greater the degree of tilt of the section to which the cylinders are attached. When the twin cylinders 50, 52, 64 and 66 are extended equally, the longitudinal axes of the patient support sections 16 and 20 are parallel to the plane of the floor 90. When the twin cylinders 50, 52, 64 and 66 are not extended equally, the patient support surface assumes a flexed position as described above. Examples of flexed positions are illustrated in FIGS. 5 and 6.

The lateral position of patient support surface 12 is determined by the relative degrees of extension of column 48 and column 62 as may be determined by their twin cylinder components 50, 52 and 64, 66, respectively. For example, referring to FIG. 7, when twin cylinders 64 and 66 are equally extended to lengths which are greater than the lengths to which twin cylinders 50 and 52 are equally extended, the patient support surface 12 is tilted to the left. Alternatively, when twin cylinders 64 and 66 are equally retracted to lengths which are lesser than the lengths of twin cylinders 50 and 52, the patient support surface 12 is tilted to the right. It can be seen that by appropriate adjustments to the twin cylinders 50, 52, 64 and 66 of support columns 48 and 62, varying degrees of lateral tilt can be achieved with respect to the floor 90. Coupled with the individual actuation of each twin cylinder 50, 52, 64 and 66, various flex positions can be achieved together with a range of lateral tilt positions to provide a variety of necessary patient positions for surgical procedures.

Referring to FIG. 5, the position of pelvic section 18 is determined by the relative positions of spinal section 16 and femoral section 20. The positions of head section 14 and foot sections 24 and 26 are determined in part by the positions of sections 16 and 20, respectively, and in part by manual adjustment of sections 14, 24 and 26. It will be observed that because of the rigidity of pelvic section 18 there is a limit to the degree of flex obtainable by adjustment of the lengths of twin cylinders 50, 52, 64 and 66 alone. Accordingly, with reference to FIG. 6, column 48 may be provided with pivotal attachment points 58 and 60 at the base ends of twin cylinders 50 and 52 so that spinal section 16 and pelvic section 18 assume a greater degree of tilt in response to the pull of femoral section 20 on axis 32 of pelvic section 18 as femoral section 20 assumes a greater degree of tilt. Column 62 is necessarily fixed at point 74 to base extension 84 in order to provide the requisite stability. It should be noted that anyone of the four twin cylinders 50, 52, 64 or 66, can be fixedly attached to the base 78 to provide such stability, if this embodiment is chosen.

Figure 4:
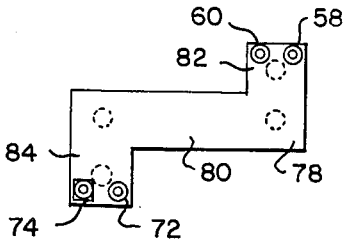
FIG. 4 is a top plan view of a preferred base construction.

In one preferred embodiment of base member 78, as illustrated in FIG. 4, there may be two oppositely protruding lateral extensions 82 and 84, one at each end of a center base portion 80. The base member 78 is proportioned such that there is adequate clearance for access to auxiliary apparatus. For example, in order to provide the necessary clearance for standard image amplification equipment around a standard sized patient support surface, the base member 78 can be proportioned such that the height from the floor 90 to the top of base member 78 is nine inches, the width of the center base portion 80 is seven inches and the length from the short inner edge of lateral extension 82 to the end of foot section 22 for purposes of lower body scans is approximately 50 inches and the length from the short inner edge of lateral extension 84 to the beginning of head section 14 for purposes of upper body scans is approximately 40 inches. The base 78 may be fixed to the floor 90 by any suitable means or it may rest on four swivel casters 86 having suitable floor locks for stability.

What is claimed is:

1. A surgical table comprising:

a base;

a patient support surface disposed above said base, said surface having a longitudinal axis, a transverse axis and five sections including a head section, a spinal section, a pelvic section, a femoral section and a foot section, each said section being pivotally connected to at least one other said section;

two columns extending vertically from said base to said surface, each said column having two points of attachment to a said section, said columns being disposed on opposite sides of the longitudinal axis of said surface and offset from the transverse axis of said surface, each said column being adapted for extension and retraction, one said column extending from said base to said spinal section and the other said column extending from said base to said femoral section; and means for individually extending and retracting said columns to position said sections of said surface.

2. A surgical table as recited in claim 1, wherein the position of said pelvic section is determined by the relative positions of said spinal and said femoral sections.

* * * * *

UNITED STATES PATENT AND TRADEMARK OFFICE

CERTIFICATE OF CORRECTION

PATENT NO. : 4,474,364

DATED : October 2, 1984

INVENTOR(S) : Thomas Brendgord

It is certified that error appears in the above—identified patent and that said Letters Patent is hereby corrected as shown below:

Col. 1, line 36, delete "a".

Signed and Sealed this

*Twelfth* Day of *March 1985*

[SEAL]

*Attest:*

DONALD J. QUIGG

*Attesting Officer* *Acting Commissioner of Patents and Trademarks*